US007153189B2

(12) United States Patent
Morita et al.

(10) Patent No.: US 7,153,189 B2
(45) Date of Patent: Dec. 26, 2006

(54) COOLANT SUPPLY METHOD AND APPARATUS FOR GRINDING MACHINE

(75) Inventors: Hiroshi Morita, Hoi-gun (JP); Kimihiro Ban, Tokai (JP); Shinichi Yokota, Okazaki (JP)

(73) Assignees: JTEKT Corporation, Osaka (JP); Toyoda Van Moppes Ltd., Okazaki (JP)

( * ) Notice: Subject to any disclaimer, the term of this patent is extended or adjusted under 35 U.S.C. 154(b) by 0 days.

(21) Appl. No.: 11/401,323

(22) Filed: Apr. 11, 2006

(65) Prior Publication Data

US 2006/0246823 A1 Nov. 2, 2006

(30) Foreign Application Priority Data

Apr. 28, 2005 (JP) ..... 2005-131105

(51) Int. Cl.
*B24B 49/00* (2006.01)

(52) U.S. Cl. ..... 451/7; 451/449

(58) Field of Classification Search ..... 451/7, 451/36, 37, 48, 57, 60, 449, 450, 446
See application file for complete search history.

(56) References Cited

U.S. PATENT DOCUMENTS 6,305,183 B1 * 10/2001 Mukai et al. ..... 62/376
6,669,532 B1 * 12/2003 Mukai et al. ..... 451/7
6,921,321 B1 7/2005 Morita
6,932,673 B1 * 8/2005 Morita et al. ..... 451/7
7,014,528 B1 * 3/2006 Mizutani et al. ..... 451/7
7,044,840 B1 * 5/2006 Yoshimi et al. ..... 451/53

FOREIGN PATENT DOCUMENTS

| | | |
|---|---|---|
| JP | 61-241065 | 10/1986 |
| JP | 10-296633 | 11/1998 |
| JP | 2003-275958 | 9/2003 |
| JP | 2004-17265 | 1/2004 |

* cited by examiner

*Primary Examiner*—Dung Van Nguyen
(74) *Attorney, Agent, or Firm*—Oblon, Spivak, McClelland, Maier & Neustadt, P.C.

(57) ABSTRACT

In a coolant supply method and apparatus for a grinding machine, when an end surface of a workpiece is ground with a grinding wheel end surface of a grinding wheel with coolant being supplied toward a grinding point, a first coolant flow is ejected toward a first position which is on the grinding wheel end surface on an upstream side of the grinding point, and intercepts an air layer rotating to follow the grinding wheel end surface. At the same time, a second coolant flow is ejected toward a second position which is on the grinding wheel end surface and which is closer to the grinding point than the first point, and clings onto the grinding wheel end surface at the second position where the follow air layer has been intercepted by the first coolant flow. Thus, the coolant of a sufficient volume can be supplied to the grinding point where the grinding wheel end surface grinds the end surface of the workpiece.

10 Claims, 4 Drawing Sheets

COOLANT SUPPLY METHOD AND APPARATUS FOR GRINDING MACHINE

INCORPORATION BY REFERENCE

This application is based on and claims priority under 35 U.S.C. 119 with respect to Japanese Application No. 2005-131105 filed on Apr. 28, 2005, the entire content of which is incorporated herein by reference.

BACKGROUND OF THE INVENTION

1. Field of the Invention

The present invention relates to a coolant supply method and apparatus for intercepting an air layer rotating to follow a grinding wheel end surface to supply coolant of a sufficient volume to a grinding point in a grinding machine which grinds an end surface of a workpiece with a grinding wheel end surface of the grinding wheel.

2. Discussion of the Related Art

In a grinding machine having a grinding wheel drivingly rotatably supported on a wheel head and a workpiece drivingly rotatably supported on a workpiece support device, it is often the case that the wheel head is advanced toward the workpiece support device with coolant being supplied to a grinding point so that both ends surfaces of the grinding wheel respectively grind both end surfaces of a ground portion taking the shape of a concave groove on the workpiece and the circumferential surface of the grinding wheel then grinds a cylindrical external surface of the workpiece. In this case, the rotation of the grinding wheel causes air layers rotate to follow the grinding wheel end surfaces, and the air layers obstruct the flows of the coolant along the grinding wheel end surfaces to make the coolant supply to grinding points insufficient. For this reason and due to the fact that contact areas increase at the grinding points where the grinding wheel end surfaces each being flat are brought into contact respectively with the workpiece end surfaces, each of the workpiece end surfaces would suffer grinding burns during the grinding operation.

Japanese unexamined, published patent application No. 2004-17265 (equivalent: U.S. Pat. No. 6,921,321) describes a device for intercepting air layers rotating to follow a grinding wheel. Referring now to the drawings of the Japanese application, in order to prevent air layers which rotate together with a grinding wheel G to follow both end surfaces 23a, 23b of the same from reaching grinding points, the device is constructed to obliquely eject air jets 29, 29 respectively toward both end surfaces 23a, 23b of the grinding wheel G, wherein each of the air jets 29, 29 is ejected from a point 26, which is on a grinding wheel circumferential edge on an upstream side of a corresponding grinding point P, along the chord of a small arc section 27 on the grinding wheel front side including the grinding point P. The device is also provided with an air interception plate 31 which faces the both end surfaces 23a, 23b of the grinding wheel G with a slight clearance therebetween.

Further, there has also been known a right-angle nozzle type device shown in FIG. 6 of the present application. In the right-angle nozzle type device, in order that air layers 40 rotating to follow both end surfaces of a grinding wheel G are intercepted for supplying coolants of a sufficient volume to grinding points where the both end surfaces respectively grind workpiece end surfaces, a pair of first nozzles 41 and a pair of second nozzles 42 are respectively arranged at first and second positions on the upstream side of the grinding points and are oriented to face the grinding wheel end surfaces at right angles, respectively.

In the wheel follow air layer intercepting device described in the aforementioned Japanese application, the position where the air interception plate 31 is mounted has to be far from the grinding points P to avoid the interference of the air interception plate 31 with the workpiece W, so that there cannot be attained a substantial effect of the air interception plate 31 in intercepting the air layers. Thus, the flow volume of each air jet 29 has to be increased for the substantial effect, thereby resulting in the massive air consumption.

In the aforementioned right-angle nozzle type device, it is intended to intercept the air layers 40 rotating to follow the grinding wheel end surfaces by the coolant flows which are ejected from the first and second nozzles 41, 42 at right angles toward the grinding wheel end surfaces and hence, to let the coolants cling onto the grinding wheel end surfaces. However, since the first and second nozzles eject the coolant flows toward the grinding wheel end surfaces at right angles, the splashing of the coolant wide spreads, and in addition, each coolant flow ejected toward the corresponding grinding wheel end surface at the second position adversely intercepts the coolant flow which has clung onto the corresponding grinding wheel end surface at the first position, so that the flow volume of the coolant rotating to follow each grinding wheel end surface becomes insufficient at the grinding point.

SUMMARY OF THE INVENTION

It is therefore a primary object of the present invention to provide an improved coolant supply method and apparatus capable of supplying coolant of a sufficient volume to a grinding point where a grinding wheel end surface grinds a workpiece end surface, without being obstructed by an air layer rotating to follow a grinding wheel and of being low in cost and simple in construction.

Briefly, according to the present invention, there is provided a coolant supply method for a grinding machine wherein a grinding wheel rotatably carried on a wheel head and a workpiece supported on a workpiece support device are relatively moved to grind an end surface of the workpiece with a grinding wheel end surface of the grinding wheel with coolant being supplied to a grinding point therebetween. The method comprises the steps of providing first and second nozzles for respectively ejecting first and second coolant flows toward a first position which is on the grinding wheel end surface on an upstream side of the grinding point, and a second position which is on the grinding wheel end surface and which is closer to the grinding point than the first position; ejecting the first coolant flow from the first nozzle in a direction which is inclined at a predetermined angle relative to the grinding wheel end surface when viewed in a direction parallel to a plane including the rotational axes of the grinding wheel and the workpiece, to intercept a follow air layer on the grinding wheel end surface by the first coolant flow; and ejecting the second coolant flow from the second nozzle in a direction which is inclined at a smaller predetermined angle than the inclination angle of the first coolant flow relative to the grinding wheel end surface when viewed in the direction parallel to the plane, to make the second coolant flow cling onto the grinding wheel end surface at the second position where the follow air layer has been intercepted by the first coolant flow.

With this construction, when the end surface of the workpiece is ground with the grinding wheel end surface of the grinding wheel with coolant being supplied toward the grinding point, the first coolant flow ejected toward the first position which is on the grinding wheel end surface on the upstream side of the grinding point, intercepts the air layer rotating to follow the grinding wheel end surface. Thus, the second coolant flow ejected toward the second position which is on the grinding wheel end surface and which is closer to the grinding point than the first point, is made to cling onto the grinding wheel end surface at the second position where the follow air layer has been intercepted by the first coolant flow, and a thick layer of the coolant can be formed on the grinding wheel end surface. Therefore, the coolant of a sufficient volume can be supplied to the grinding point where the grinding wheel end surface grinds the end surface of the workpiece. This advantageously results in enhancement of the cooling efficiency at the grinding point, the suppression of the thermal expansion of the workpiece being ground and a substantial reduction of the grinding resistance which is generated when the grinding wheel end surface grinds the workpiece end surface. As a consequence, it can be realized to grind the workpiece end surface efficiently and precisely without the workpiece end surface suffering grinding burns.

In another aspect of the present invention, there is provided a coolant supply device for a grinding machine wherein a grinding wheel rotatably carried on a wheel head and a workpiece supported on a workpiece support device are relatively moved to grind an end surface of the workpiece with a grinding wheel end surface of the grinding wheel with coolant being supplied to a grinding point therebetween. The device comprises first and second nozzles for respectively ejecting first and second coolant flows toward a first position which is on the grinding wheel end surface on an upstream side of the grinding point, and a second position which is on the grinding wheel end surface and which is closer to the grinding point than the first position. The first nozzle is arranged to incline the ejection direction of the first coolant flow at a predetermined angle relative to the grinding wheel end surface when viewed in a direction parallel to a plane including the rotational axes of the grinding wheel and the workpiece, to intercept a follow air layer on the grinding wheel end surface by the first coolant flow, and the second nozzle is arranged to incline the ejection direction of the second coolant flow at a smaller predetermined angle than the inclination angle of the first coolant flow relative to the grinding wheel end surface when viewed in the direction parallel to the plane, to make the second coolant flow cling onto the grinding wheel end surface at the second position where the follow air layer has been intercepted by the first coolant flow.

With the construction in the second aspect of the present invention, the first coolant flow ejected from the first nozzle toward the first position which is on the upstream side of the grinding point, intercepts the air layer rotating to follow the grinding wheel end surface. Thus, the second coolant flow ejected from the second nozzle toward the second position which is closer to the grinding point than the first point, is made to cling onto the grinding wheel end surface at the second position where the follow air layer has been intercepted by the first coolant flow. Therefore, the coolant of a sufficient volume can be supplied to the grinding point. Accordingly, the coolant supply device which is capable of grinding the workpiece end surface efficiently and precisely can be provided in a low cost and in a simplified construction.

BRIEF DESCRIPTION OF THE DRAWINGS

The foregoing and other objects and many of the attendant advantages of the present invention may readily be appreciated as the same becomes better understood by reference to the preferred embodiment of the present invention when considered in connection with the accompanying drawings, wherein like reference numerals designate the same or corresponding parts throughout several views, and in which.

DESCRIPTION OF A PREFERRED EMBODIMENT OF THE INVENTION

Figure 1:
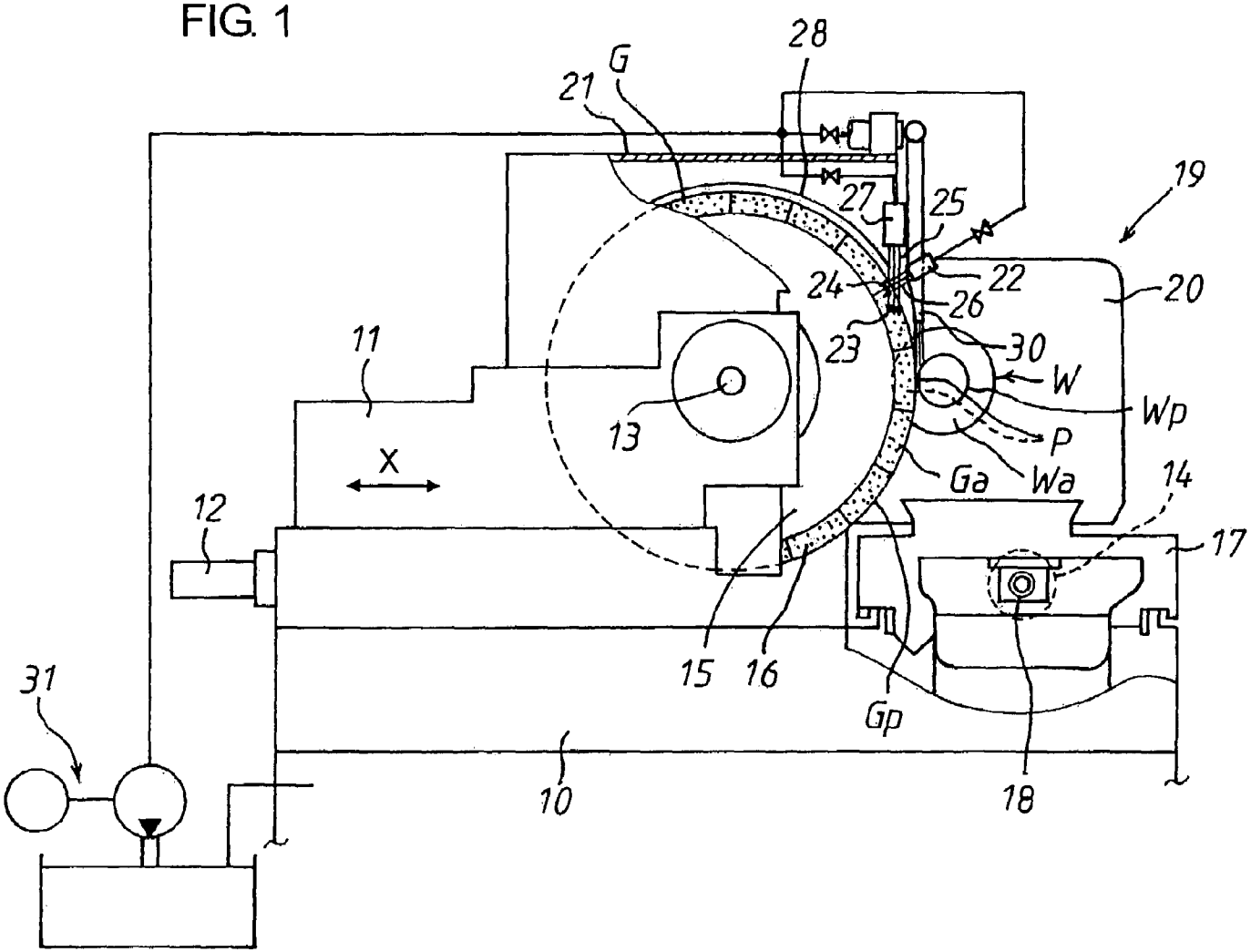
FIG. 1 is a side elevational view partly in section of a grinding machine provided with a coolant supply device according to the present invention.
Figure 2:
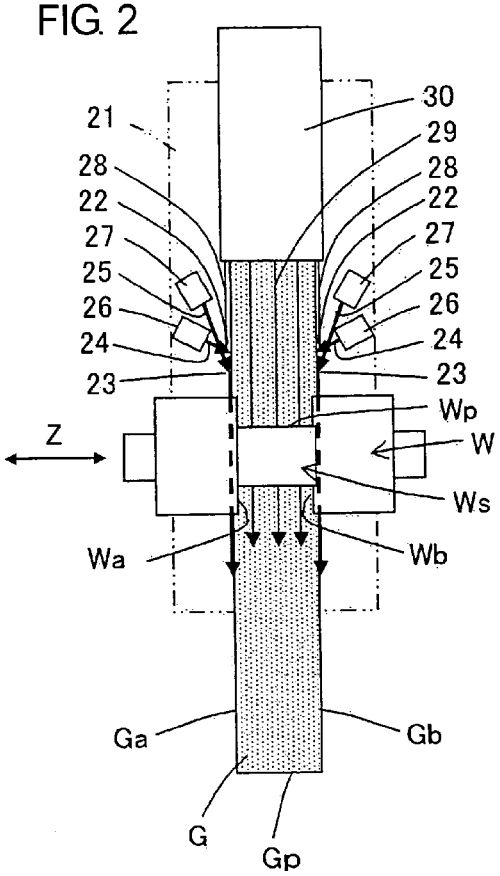
FIG. 2 is a front view of the coolant supply device.

Hereafter, a coolant supply method and apparatus in one embodiment according to the present invention will be described with reference to the accompanying drawings. Referring now to FIGS. 1 and 2, a wheel head 11 is slidably mounted on a bed 10 and is advanced and retracted by a servomotor 12 through a ball screw mechanism (not sown) in an X-axis direction. A wheel spindle 13 with a grinding wheel G attached to one end thereof is rotatably carried on the wheel head 11 and is rotationally driven by an electric motor (not shown). The grinding wheel G is constructed by bonding a plurality of grinding chips 16 on the circumferential surface of a disc-like base member 15 formed of a metal such as iron or the like. A table 17 is slidably mounted on the bed 10 and is moved by a servomotor 14 through a ball screw mechanism 18 in a Z-axis direction extending perpendicular to the X-axis direction. Mounted on the table 14 are a work head 20 and a foot stock (not shown) which constitute a workpiece support device 19. The workpiece W is supported to be pinched between a pair of centers of the work head 20 and the foot stock and is drivingly rotated by a workpiece drive motor (not shown). The workpiece W has a ground portion Ws taking the shape of a concave groove. When the wheel head 11 is advanced toward the workpiece support device 19 in the X-axis direction with coolant being supplied toward the grinding points P, both end surfaces Wa, Wb of the ground portion Ws are ground at the grinding points P with grinding end surfaces Ga, Gb which are opposite end surfaces in the width direction of the grinding chips 16 of the grinding wheel G, and a cylindrical external surface Wp of the ground portion Ws is then ground at the grinding point P with a circumferential surface Gp of the grinding wheel G.

A wheel guard 21 for covering the grinding wheel G is fixed to the wheel head 11. The wheel guard 21 has fixed thereto a pair of first nozzles 26 for respectively ejecting first coolant flows 24 toward first positions 22 which are on the grinding wheel end surfaces Ga, Gb on the upstream side of the grinding points P in the rotational direction of the grinding wheel G. The wheel guard 21 has also fixed thereto a pair of second nozzles 27 for respectively ejecting second coolant flows 25 toward second positions 23 which are on the grinding wheel end surfaces Ga, Gb on the upstream side of the grinding points P in the rotational direction of the grinding wheel G and which are closer to the grinding points P than the first positions 22. Further, the wheel guard 21 has also fixed thereto a third nozzle 30 for ejecting a third coolant flow 29 toward the grinding point P on the circumferential surface Gp of the grinding wheel G. These first through third nozzles 26, 27 and 30 are fluidly connected to a coolant supply unit 31.

Figure 3:
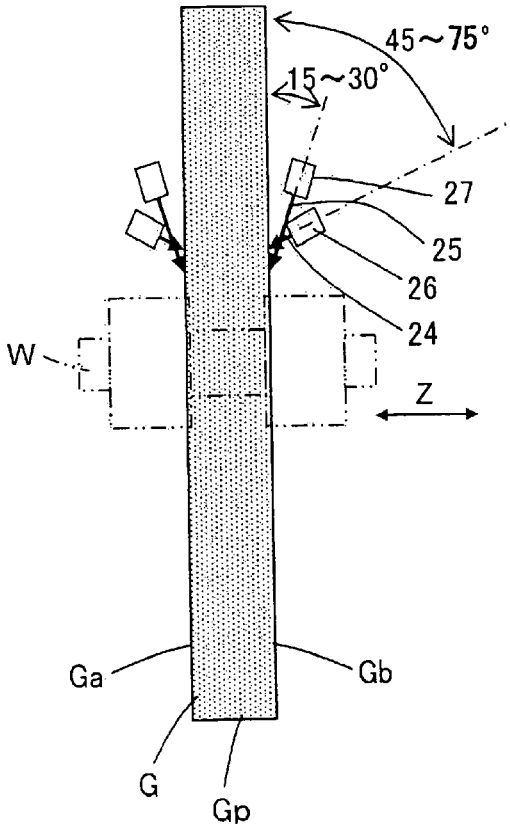
FIG. 3 is an explanatory view, as viewed in a direction parallel to a plane including the rotational axes of a grinding wheel and a workpiece, for showing the inclination angles of first and second coolant flows toward the grinding wheel end surfaces.
Figure 4:
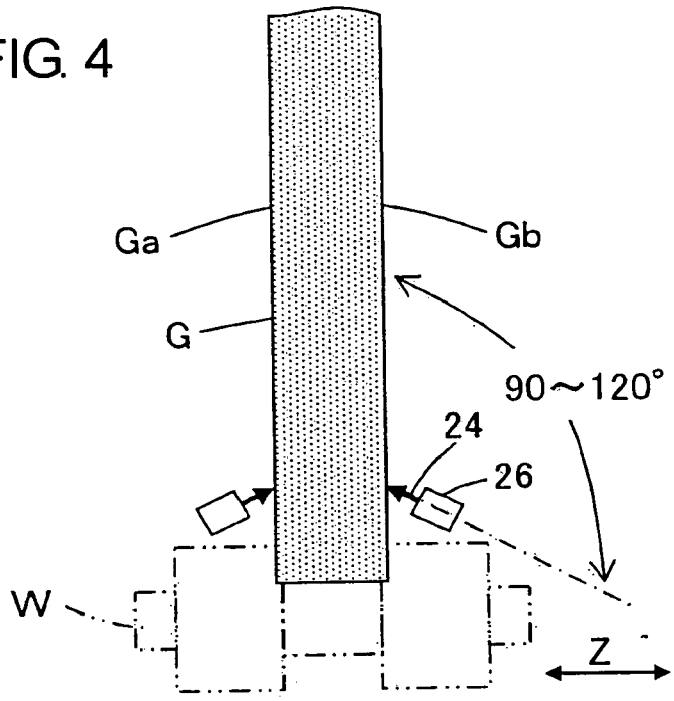
FIG. 4 is an explanatory view, as viewed in a direction normal to the plane including the rotational axes of the grinding wheel and the workpiece, for showing the inclination angle of the first coolant flows toward the grinding wheel end surfaces.
Figure 5:
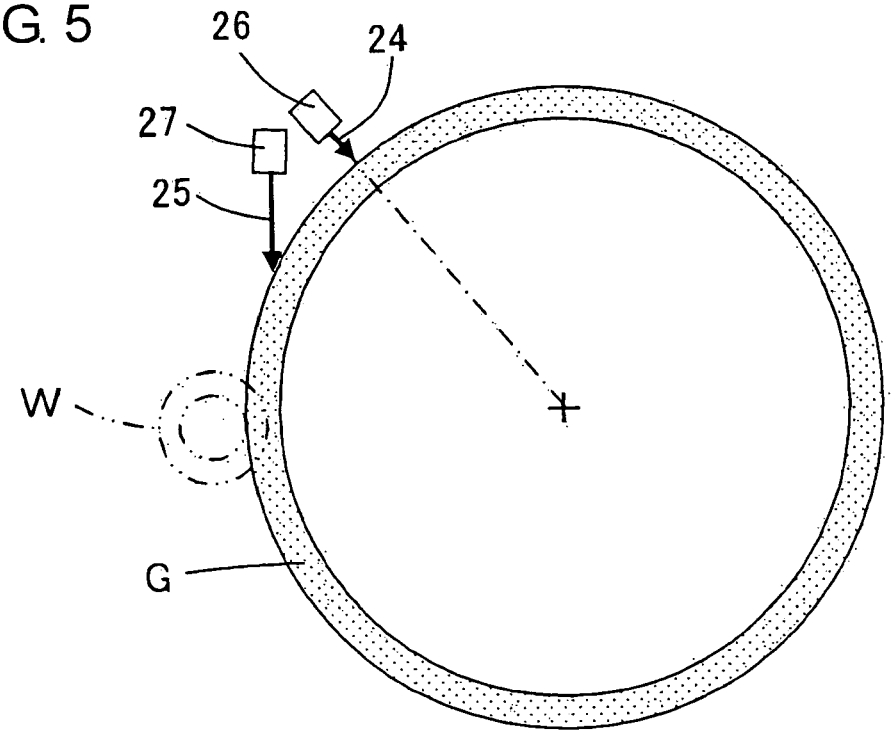
FIG. 5 is an explanatory view, as viewed in a direction parallel to the rotational axis of the grinding wheel, for showing the directions in which the first and second coolant flows are ejected respectively.
Figure 6:
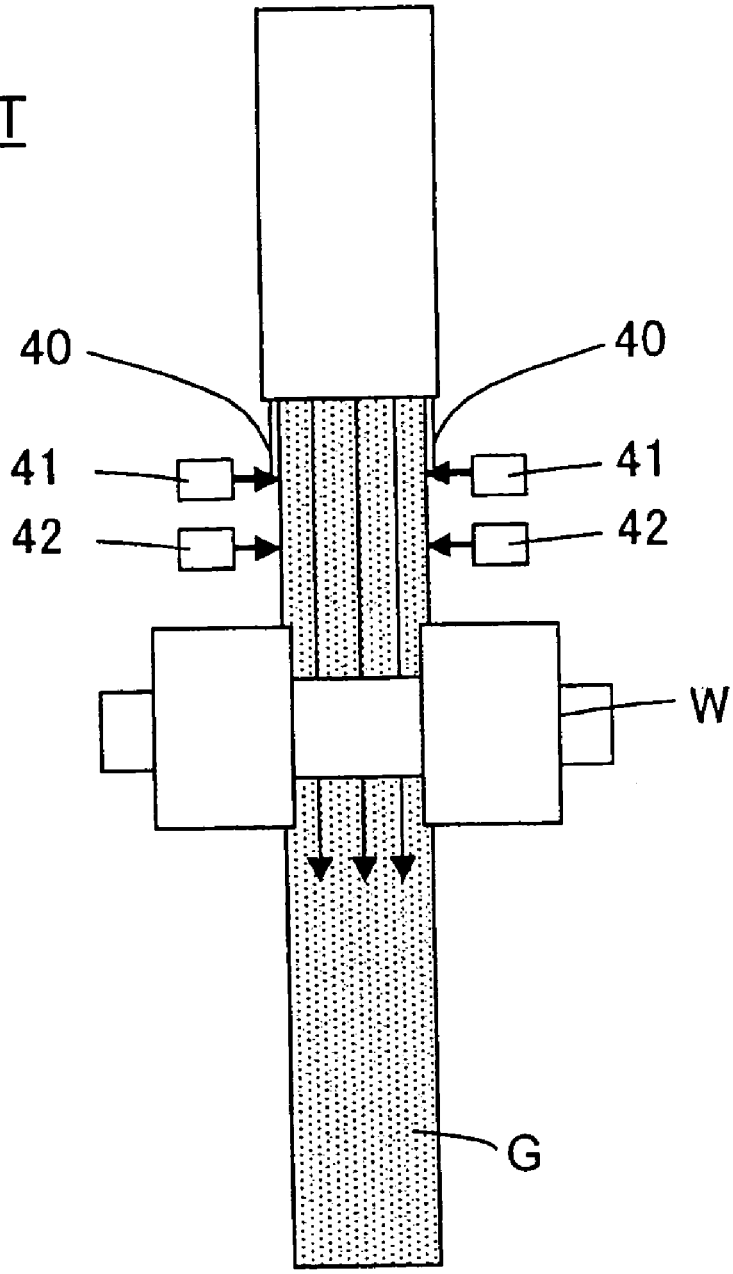
FIG. 6 PRIOR ART
FIG. 6 is a front view of a prior art coolant supply device.

As shown in FIG. 3, in order that the first coolant flows 24 can respectively intercept air layers 28 rotating to follow the grinding wheel end surfaces Ga, Gb, each of the first nozzles 26 is arranged to incline the ejection direction of the first coolant flow 24 at a predetermined angle in a range of 45 through 75 degrees relative to the grinding wheel end surface Ga or Gb corresponding thereto, when viewed from the front side of the grinding wheel G in a direction parallel to a plane including the rotational axes of the grinding wheel G and the workpiece W. As shown in FIG. 4, each first nozzle 26 is also arranged to incline the ejection direction of the first coolant flow 24 at a predetermined angle in a range of 90 through 120 degrees relative to the grinding wheel end surface Ga or Gb corresponding thereto, when viewed in a direction normal to the plane including the rotational axes of the grinding wheel G and the workpiece W. Thus, as shown in FIG. 5, the ejection direction of each first coolant flow 24 is oriented in a direction normal to the grinding wheel G when viewed in a direction parallel to the rotational axis of the grinding wheel G.

As shown in FIG. 3, in order that the second coolant flows 25 can respectively cling onto the grinding wheel end surfaces Ga, Gb at the second positions 23 where the follow air layers 28 have been intercepted by the first coolant flows 24, each of the second nozzles 27 is arranged to incline the ejection direction of the second coolant flow 25 at a predetermined angle in a range of 15 through 30 degrees which is smaller than the inclination angle of the first coolant flow 24, relative to the grinding wheel end surface Ga or Gb corresponding thereto, when viewed from the front side of the grinding wheel G in the direction parallel to the plane including the rotational axes of the grinding wheel G and the workpiece W. Thus, as view in FIG. 5, the ejection direction of each second coolant flow 25 is oriented in a direction tangential to the grinding wheel G when viewed in the direction parallel to the rotational axis of the grinding wheel G.

The flow rate and flow volume of each first coolant flow 24 are set to be smaller than or equal to those of each second coolant flow 25. Where the flow rate and flow volume of each first coolant flow 24 are set to relatively small flow rate and flow volume of the degree that enables the air layers 28 following the grinding wheel end surfaces Ga, Gb to be intercepted, the splashing of the coolant can be further prevented.

(Operation)

The operation of the embodiment as constructed above will be described hereafter. When the workpiece W is supported between the both centers of the work head 20 and the foot stock (not shown) and is rotated, the table 17 is moved by the servomotor 14 in the Z-axis direction to index the ground portion Ws to a position where the ground portion Ws faces the grinding wheel G. A motor (not numbered) of the coolant supply unit 31 is started to drive a pump (not numbered), and thus, coolants are supplied from the first through third nozzles 26, 27 and 30 toward the both grinding wheel end surfaces Ga, Gb and the circumferential surface Gp of the grinding wheel G. The wheel head 11 is then advanced by the servomotor 12 at an end surface grinding feed rate, whereby the both end surfaces Wa, Wb of the workpiece W are ground at the grinding points P with the both grinding wheel end surfaces Ga, Gb of the grinding wheel G rotating at a high speed. Upon termination of the grindings on the both end surfaces Wa, Wb, the wheel head 11 is further advanced at rough and fine grinding feed rates in succession, whereby the cylindrical external surface Wp of the workpiece W is ground roughly and then finely at the grinding point P with the cylindrical surface Gp of the grinding wheel G. The grinding infeed of the wheel head 11 is then discontinued to perform a spark-out grinding on the cylindrical external surface Wp.

During the foregoing grinding operation or particularly, at least during the foregoing grinding step for the workpiece end surfaces Wa, Wb, the first coolant flow 24 from each first nozzle 26 is ejected in the direction which is inclined at the predetermined angle in the range of 45 through 75 degrees relative to the grinding end surface Ga or Gb corresponding thereto when viewed in the direction parallel to the plane including the rotational axes of the grinding wheel G and the workpiece W and which is also inclined at the predetermined angle in the range of 90 through 120 degrees relative to the grinding end surface Ga or Gb corresponding thereto when viewed in the direction normal to the plane including the rotational axes of the grinding wheel G and the workpiece W. Each first coolant flow 24 is blown against the first position 22 on the upstream side of the grinding point P on the corresponding grinding wheel end surface Ga or Gb. Thus, the air layers 28 rotating to follow the grinding wheel end surfaces Ga and Gb can be intercepted by the first coolant flows 24.

Further, the second coolant flow 25 from each second nozzle 27 is ejected in the direction which is inclined at the smaller predetermined angle in the range of 15 through 30 degrees than the inclination angle of the first coolant flow 24 relative to the grinding end surface Ga or Gb corresponding thereto when viewed in the direction parallel to the plane including the rotational axes of the grinding wheel G and the workpiece W. Each second coolant flow 25 is blown against the second position 23 which is closer to the grinding point P on the corresponding grinding wheel end surface Ga or Gb than the first position 22. Thus, the second coolant flow 25 from each second nozzle 27 can cling onto the corresponding grinding wheel end surface Ga or Gb at the second position 23 where the follow air layer 28 has been intercepted by the first coolant flow 24 and forms a thick layer of coolant on the corresponding grinding wheel end surface Ga or Gb. Accordingly, the coolants of a sufficient volume can be respectively supplied to the grinding points P where the respective grinding wheel end surfaces Ga, Gb grind the respective end surfaces Wa, Wb of the workpiece W. This advantageously results in enhancement of the cooling efficiency at each grinding point P, the suppression of the thermal expansion of the workpiece W being ground and the reduction by forty (40) percents or so of the grinding resistance which is generated when the grinding wheel end surfaces Ga, Gb grind the workpiece end surfaces Wa, Wb. As a consequence, it can be realized to grind the workpiece end surfaces Wa, Wb efficiently and precisely without the both end surfaces Wa, Wb of the workpiece W suffering grinding burns.

That is, according to the aforementioned embodiment, since the second coolant flows 25 ejected from the second nozzles 27 toward the second positions 23 which are closer to the grinding points P than the first positions 22, are made to cling onto the grinding wheel end surfaces Ga, Gb at the second positions 23 where the follow air layers 28 have been intercepted by the first coolant flows 24, the coolants of the sufficient volume can be supplied to the grinding points P. Accordingly, the coolant supply device which is capable of grinding the workpiece end surfaces Wa, Wb efficiently and precisely can be provided in a low cost and in a simplified construction.

Further, since the angle which each second coolant flow 25 makes with the corresponding grinding wheel end surface Ga or Gb is set in the range of 15 through 30 degrees, the second coolant flows 25 are made to cling onto the grinding wheel end surfaces Ga, Gb smoothly and reliably, so that it becomes realized to supply the coolants of the sufficient volume to the grinding points P on the grinding wheel end surfaces Ga, Gb.

Further, since the angle which each first coolant flow 24 makes with the corresponding grinding wheel end surface Ga or Gb is set in the range of 45 through 75 degrees, the first coolant flows 24 can reliably intercept the follow air layers 28 on the grinding wheel end surfaces Ga, Gb, and some parts of the first coolant flows 24 can cling thereto to be conveyed to the grinding points P.

Furthermore, since when viewed in the direction parallel to the rotational axis of the grinding wheel G, each first coolant flow 24 and each second coolant flow 25 are ejected respectively in the normal direction and the tangential direction with respect to the grinding wheel G, the first coolant flows 24 can intercept the follow air layers 28 on the grinding wheel end surfaces Ga, Gb with the splashing thereof being suppressed, and the second coolant flows 25 can smoothly cling onto the grinding wheel end surfaces Ga, Gb at the second positions 23 where the follow air layers 28 have been intercepted by the first coolant flows 24.

Still furthermore, since when viewed in the direction perpendicular to the plane including the rotational axes of the grinding wheel G and the workpiece W, the angle which each first coolant flow 24 makes with the corresponding grinding wheel end surface Ga or Gb is set in the angular range of 90 through 120 degrees, the first coolant flows 24 can intercept the follow air layers 28 on the grinding wheel end surfaces Ga, Gb with the splashing thereof being suppressed.

(Modifications)

Although the foregoing embodiment is described as being practiced in a grinding machine of the type wherein the grinding wheel G has the both end surfaces Ga, Gb extending perpendicular to the cylindrical surface Gp, it may also be practiced in an angle slide grinding machine wherein the rotational axis of an angle grinding wheel extends inclined relative to the foregoing Z-axis and wherein a truing device is able to form both end surfaces of the grinding wheel in parallel to the foregoing X-axis and a circumferential surface of the grinding wheel in parallel to the foregoing Z-axis. In this modification, each of the foregoing first coolant flows 24 and each of the foregoing second coolant flows 25 are ejected from the foregoing first and second nozzles 26, 27 toward the foregoing first and second positions 22, 23 on each end surface of the angle grinding wheel.

Moreover, although the foregoing embodiment is described as being of the type wherein the both end surfaces Wa, Wb of the workpiece W are ground with the both end surfaces Ga, Gb of the grinding wheel G at a time, it may be practiced as being of another type wherein one end surface Wa or Wb only of the workpiece W is ground with the grinding wheel G or wherein they are ground individually at different times.

Obviously, numerous further modifications and variations of the present invention are possible in light of the above teachings. It is therefore to be understood that within the scope of the appended claims, the present invention may be practiced otherwise than as specifically described herein.

What is claimed is:

1. A coolant supply method for a grinding machine wherein a grinding wheel rotatably carried on a wheel head and a workpiece supported on a workpiece support device are relatively moved to grind an end surface of the workpiece with a grinding wheel end surface of the grinding wheel with coolant being supplied toward a grinding point therebetween, the method comprising the steps of:

providing first and second nozzles for respectively ejecting first and second coolant flows toward a first position which is on the grinding wheel end surface on an upstream side of the grinding point, and a second position which is on the grinding wheel end surface and which is closer to the grinding point than the first position;

ejecting the first coolant flow from the first nozzle in a direction which is inclined at a predetermined angle relative to the grinding wheel end surface when viewed in a direction parallel to a plane including the rotational axes of the grinding wheel and the workpiece, to intercept a follow air layer on the grinding wheel end surface by the first coolant flow; and ejecting the second coolant flow from the second nozzle in a direction which is inclined at a smaller predetermined angle than the inclination angle of the first coolant flow relative to the grinding wheel end surface when viewed in the direction parallel to the plane, to make the second coolant flow cling onto the grinding wheel end surface at the second position where the follow air layer has been intercepted by the first coolant flow.

2. A coolant supply device for a grinding machine wherein a grinding wheel rotatably carried on a wheel head and a workpiece supported on a workpiece support device are relatively moved to grind an end surface of the workpiece with a grinding wheel end surface of the grinding wheel with coolant being supplied to a grinding point therebetween, the device comprising:

first and second nozzles for respectively ejecting first and second coolant flows toward a first position which is on the grinding wheel end surface on an upstream side of the grinding point, and a second position which is on the grinding wheel end surface and which is closer to the grinding point than the first position;

wherein the first nozzle is arranged to incline the ejection direction of the first coolant flow at a predetermined angle relative to the grinding wheel end surface when viewed in a direction parallel to a plane including the rotational axes of the grinding wheel and the workpiece, to intercept a follow air layer on the grinding wheel end surface by the first coolant flow; and wherein the second nozzle is arranged to incline the ejection direction of the second coolant flow at a smaller predetermined angle than the inclination angle of the first coolant flow relative to the grinding wheel end surface when viewed in the direction parallel to the plane, to make the second coolant flow cling onto the grinding wheel end surface at the second position where the follow air layer has been intercepted by the first coolant flow.

3. The coolant supply device as set forth in claim 2, wherein the angle which the second coolant flow makes with the grinding wheel end surface is set in a range of 15 through 30 degrees.

4. The coolant supply device as set forth in claim 3, wherein the angle which the first coolant flow makes with the grinding wheel end surface is set in a range of 45 through 75 degrees.

5. The coolant supply device as set forth in claim 4, wherein when viewed in a direction parallel to the rotational axis of the grinding wheel, the ejection direction of the first coolant flow is normal to the grinding wheel, while the ejection direction of the second coolant flow is tangential to the grinding wheel.

6. The coolant supply device as set forth in claim 4, wherein when viewed in a direction perpendicular to the plane including the rotational axes of the grinding wheel and the workpiece, the ejection direction of the first coolant flow is inclined at a predetermined angle in a range of 90 through 120 degrees relative to the grinding wheel end surface.

7. The coolant supply device as set forth in claim 2, wherein the angle which the first coolant flow makes with the grinding wheel end surface is set in a range of 45 through 75 degrees.

8. The coolant supply device as set forth in claim 2, wherein when viewed in a direction parallel to the rotational axis of the grinding wheel, the ejection direction of the first coolant flow is normal to the grinding wheel, while the ejection direction of the second coolant flow is tangential to the grinding wheel.

9. The coolant supply device as set forth in claim 8, wherein when viewed in a direction perpendicular to the plane including the rotational axes of the grinding wheel and the workpiece, the ejection direction of the first coolant flow is inclined at a predetermined angle in a range of 90 through 120 degrees relative to the grinding wheel end surface.

10. The coolant supply device as set forth in claim 2, wherein when viewed in a direction perpendicular to the plane including the rotational axes of the grinding wheel and the workpiece, the ejection direction of the first coolant flow is inclined at a predetermined angle in a range of 90 through 120 degrees relative to the grinding wheel end surface.

* * * * *